US005579712A

United States Patent [19]

Rinker et al.

[11] Patent Number: 5,579,712

[45] Date of Patent: Dec. 3, 1996

[54] RELEASABLE ANCHOR

[76] Inventors: David E. Rinker, P.O. Box 1129, Cottonwood, Calif. 96022; Terry Vietz, E. 410 Main St., Pullman, Wash. 99163

[21] Appl. No.: 326,226

[22] Filed: Oct. 20, 1994

[51] Int. Cl.[6] ..... B63B 21/24

[52] U.S. Cl. ..... 114/297; 114/294

[58] Field of Search ..... 114/297, 298, 114/300, 294; 43/44.96, 44.97, 44.99, 43.12

[56] References Cited

U.S. PATENT DOCUMENTS

| | | | |
|---|---|---|---|
| 1,564,147 | 12/1925 | Stickley et al. | 43/43.12 |
| 2,326,876 | 8/1943 | Miller | 43/43.12 |
| 2,413,596 | 12/1946 | Wood, Jr. | 114/299 |
| 2,713,743 | 7/1955 | Stark | 43/43.12 |
| 3,138,134 | 6/1964 | Botine | 114/298 |
| 3,180,052 | 4/1965 | Malesko | 43/44.97 |

*Primary Examiner*—Edwin L. Swinehart

*Attorney, Agent, or Firm*—Gene Scott Patent Law & Venture Group

[57] ABSTRACT

The present invention relates to a releasable anchor for securing a boat or marine vessel to a desired position having a weighted body with a central bore extending throughout its length through which an elastic strip is pulled in such a way as to form a closed eye on one end of the weighted body and with the remainder of the elastic strip being frictionally held within the central bore of the weighted body. The elastic eye along with the weighted body may be attached to one end of an anchor line and when the anchor becomes bound by an underwater obstruction a boater may exert tension to the elastic eye by applying a pulling force to the anchor line. The exerted tension will cause the elastic strip to stretch thus reducing its diameter inside the central bore of the weighted body until the friction will no longer withhold its exit from the central bore of the weighted body. This action allows the anchor to release from the anchor line at the point of connection.

13 Claims, 2 Drawing Sheets

RELEASABLE ANCHOR

BACKGROUND OF THE INVENTION

1. Field of the Invention

This invention relates to boat anchors or fishing sinkers or the like. More specifically and particularly, the invention relates to a boat anchor which may be securely attached to the bow or stern of a boat yet maintain the ability to be disconnected from the boat when irretrievably snagged or bound by an underwater obstruction. Other objects and advantages of the invention will be understood from the following description.

2. Description of the Prior Art

The present invention is particularly useful for persons desiring an uncomplicated apparatus for being able to disconnect an anchor on a small boating craft when the anchor becomes irretrievably snagged or bound by an underwater obstruction.

Boaters and fisherman in particular commonly use anchors in order to stop and position their boats in bodies of water in order that they may effect repairs, fish more effectively or simply relax. These anchors are commonly made of lead, steel, aluminum or of various material compositions and are connected to a boat with a line made of nylon, hemp, sisal, or of other materials. Boaters have objected to this method of securing a boat at a certain point on a body of water since an anchor commonly becomes irretrievably wedged in rocks or underwater obstructions. When this occurs, it becomes necessary to cut or break the connecting line which leaves the anchor and the majority of the connecting line in the water. This is a potentially dangerous occurrence as other boat's propellers may become fouled on the free drifting cut-of lines. It is also a potentially dangerous situation as it is often necessary to remove a boat from an anchored position quickly in order to avoid oncoming obstacles, excessive turbulence or other undesirable, and, or unavoidable factors.

Thereafter, inventors created types of anchors which would grasp the bottom of a body of water in a manner which would securely hold a boat in a desired position yet allow retrieval of the anchor by repeatedly tugging at the line or repositioning the boat within the confines of available line. This method has proven to be unreliable and has resulted in many broken or cut lines. The present invention describes an anchor used for securing a boat or vessel at a desired position while maintaining the ability to be quickly disconnected from the line at the point at which the anchor connects to the line.

The prior art has proposed a number of devices for anchors. Heretofore, such devices have either involved complex mechanisms in order to release from the ocean's bottom or fold the anchor, or the devices have been cumbersome or expensive for the operator to use.

Numerous innovations for an anchor or a releasable anchor have been provided in the prior art that are described as follows. Even though these innovations may be suitable for the specific individual purposes to which they address, they differ from the present invention as hereinafter contrasted.

U.S. Pat. No. 5,188,055
Adjustable Boat Anchor
Gary P. Kasha

A boat anchor is disclosed including a fluke, having a relatively pointed tip portion and a relatively broad tail portion. A shank is fixed to the fluke rearwardly of the tip portion and extends forwardly of the tip portion to a distal end. The shank includes a generally longitudinal slot that extends from a first end proximate the distal end of the shank to an opposite second end located rearwardly of the anchor's center of gravity. The slot is slidably engageable by an anchor line and allows the anchor line to slide between the first end of the lost, wherein force may be exerted on the line to embed the tip of the fluke into the ground, and the second end of the slot, wherein force may be exerted on the line to pull the tip portion of the anchor out of the ground.

This prior art patent differs from the present invention in that the boat or vessel must be realigned with the anchor in order to be able to release the anchor. The present invention, by contrast, has a removable weight member that can be removed and replaced by the user by increasing the tension on the anchor line. This allows the boater to disengage the boat from the line without having to reposition the vessel.

U.S. Pat. No. 5,101,592
Fishing Weight
Roy K. Merritt

A fishing weights having a body, at least two fins, and a connector suitable for connecting the body to a fishing line. Each of the fins is formed longitudinally along and extending outwardly from the body. Each of the fins has a forward portion inclined with respect to the longitudinal axis of the body and a rearward portion having a greater angle of inclination than the forward portion. The rearward portion is connected to the forward portion and extends angularly outwardly therefrom. The body is pointed at one end. Each fins has a V-shaped configuration that extends from the body. An eyelet is provided for connecting the body to a fishing line. The body and the fins are integrally formed of a leaden material.

Although the above referenced prior art may be an improvement over prior types of anchors, it is not releasable and therefore, the anchor line must be cut or broken in order for the boat to disengage itself once the anchor has become irretrievably wedged in rocks or underwater obstructions. The present invention's main inventive entity is that the anchor can be released without moving the boat or cutting the anchor line.

U.S. Pat. No. 5,092,261
Boat Anchor
Ronald J. Bearand

A boat anchor with a fixed pair of flukes on the end of the shank. For the purpose of illustration, the shank is square on the lower end and around on the opposite end. A pair of movable flukes are connected with means defining a central opening which, for the purpose of illustration, is square and received on the shank to fix a position of the movable flukes relative to the fixed flukes when in the lower position, and rotatable on the round portion of the shank to selectively and alternatively position the fixed and movable flukes. Accordingly, the fixed and movable flukes are in a right-angle position when in operation and can be adjusted to a parallel position when in storage.

In the above prior art invention, the operator of the must re-position the boat in order to attempt to release the anchor when irretrievably wedged in the rocks or underwater obstructions. Although this invention can adjust its flukes for storage, it cannot release the anchor without repeatedly tugging at the line, repositioning the boat or, at worst, cutting the line. The instant invention avoids these disadvantages by making the anchor releasable from the line.

U.S. Pat. No. 3,799,098
Combination Boat Anchor and Fender
Hiram R. Taylor and Gordon L. Taylor A combination boat anchor and fender comprising an elongated, weighted element, the latter being provided with two square ends of relatively rigid but cushioning material and a square piece intermediate said ends thereof of the same or similar material and of approximately the same dimension, the element and said ends and intermediate piece being clamped together by a central rod which is threaded at one end to receive a bolt thereon and provided with a ring or loop formation at the other end to complete the clamping means, the loop affording means of line attachment thereto for anchoring purposes.

The Taylor patent, as with the other patents referenced above, has no means in which to release the anchor if the anchor has become wedged to a rock or an underwater obstruction. The inventive aspect of this prior art is its dual purpose of functioning as both an anchor and as a fender on the side of the boat.

The applicant has previously submitted this invention under Disclosure Document Program submission number 321016 dated Dec. 3, 1992 entitled "Precision Release Drift Weight". The inventor, David E. Rinker, has also previously filed for a "Snagless Sinker", Ser. No. 07/449,599 filed Dec. 12, 1989, now abandoned as of Sep. 19, 1990. Both of these documents teach common material as the present invention.

SUMMARY OF THE INVENTION

The releasable anchor comprises a tubular member attached to a heavy drag member, together acting as a boat anchor 20 lb. and up range, precision release drift weight 8–10 lb. range, or a fishing sinker 5–7 lb. range.

The device is for the purpose of providing a simple means for a fisherman to release the anchor or weight once the anchor has become irretrievably wedged in a rock or an underwater obstruction.

An elastic material is fitted into the hole in the tubular member and is of such size and resiliency as to be wedged into the tubular member. The boat anchor line, i.e. small craft, is tied to the loop. The size of the hole in the tubular member, as well as the size and mechanical characteristics of the elastic loop are chosen so that the loop pulls free of the anchor at a predetermined tension. Thus, the anchor can be jettisoned if it is caught on the bottom without loosing the line to which it is attached.

The releasable anchor assembly is mainly comprised of two parts; the weighted body with a central bore and an elastic strip. The weighted body is made lead, steel, cast iron, aluminum or any substance with a specific gravity greater than one. The central bore extends throughout the length of the weighted body. The elastic strip is made out of latex, robber or any other elastic material.

The releasable anchor is assembled by pulling the elastic strip into the central bore of the weighted body with a hook-end tool in such a way as to form a closed eye on one end of the weighted body. By way of example, the present invention works by attaching one end of an anchor line to the closed eye of the anchor and the opposite end of the anchor line to the bow or stern of the boat being anchored. When the anchor becomes solidly lodged or bound by an underwater obstruction a boater may secure release of the anchor at the point where the anchor eye is attached to the anchor line by pulling on the anchor line. The elastic strip will react to this applied tension by stretching, thereby reducing its diameter until it reaches the diameter whereas friction will no longer withhold its exit from the central bore of the weighted body. This action releases the anchor from the anchor line at a consistent tension requirement and may be adjusted for heavier or lighter tension requirements by mechanically varying the diameter of the central bore of the weighted body.

Accordingly, the releasable anchor provides a safe, reliable anchor which is easy to attach or disconnect from an anchor line and provides a variable, consistent release tension requirement. Through experimentation one is able to select a central bore size and an elastic strip of such size and elastic characteristics as to enable exact release force prediction.

Although normally made from metal or metal alloys, the weighted body may be made of a substance other than metal or metal alloys, and may be of any shape other than cylindrical, so long as the shape allows the boat to be secured to a position through either total weight of the anchor or through grasping subsurface objects. If the securing is by way of using the total weight, then the weighted body must have a specific gravity greater than one in order to sink. The central bore may be tapered or varied in diameter within its length or may have a consistent girth or diameter. The bore may also be mechanically constricted or expanded to reduce or expand the diameter. The elastic strip that gets inserted into the bore may be any cross-sectional shape, e.g. square, round, rectangular, hexagonal or octagonal and the strip may be reinforced or laminated.

Accordingly, it is an object of the present invention to provide an uncumbersome and safe way for the user to be able to release the anchor without having to reposition the boat multiple times or to cut or break the anchor line. More particularly, it is an object of the present invention to provide a simple means for any boat operator to quickly release the anchor once it has become irretrievably wedged in a rock or an underwater obstruction. A further object of the present invention is to provide a safe means for the boating operator to release the anchor without having to dangerously reposition his boat multiple times in order to dislodge the anchor. Still another object of the present invention is to provide a reliable, releasable anchor which is easily attached to a boat by traditional or conventional means. A yet further object of the instant invention is to allow pre-selection of a release tension to enable the anchor to release prior to breaking the line or the boat fixture to which the line is attached.

A further feature of the present invention is to be able to vary the amount of tension required to insure that the anchor release may be adjusted for heavier or lighter pressure release by mechanically decreasing or expanding the diameter of the central bore. The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

DETAILED DESCRIPTION OF THE PREFERRED EMBODIMENT

Figure 1:
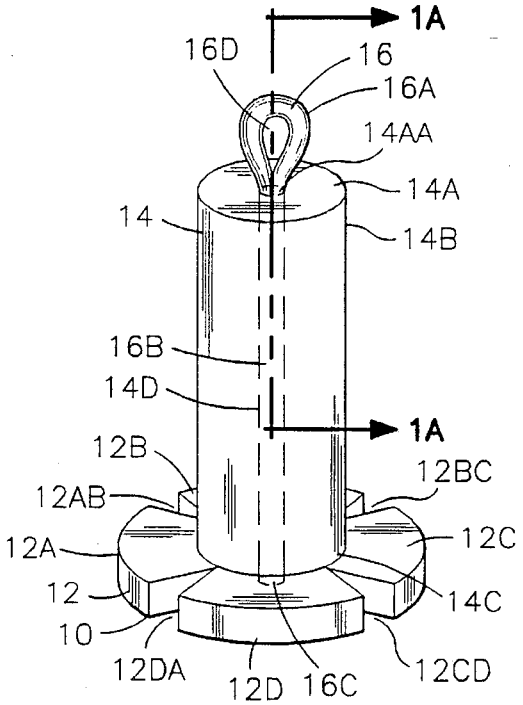
FIG. 1 is a perspective view of the releasable anchor with the elastic material wedged into the tubular member.

Firstly, referring to FIG. 1 showing a pictorial view of the releasable anchor with the elastic material wedged into the tubular member, exhibiting the following features: releasable anchor 10 comprising a drag member 12, a tubular weighted member 14, both of the later preferably constructed from metal alloys, individually and in combination such as metal, metal alloys, lead, steel, cast iron, and aluminum, and an elastic strip 16 preferably constructed from a group of stretchable materials individually and in combination such as nylon, polypropylene, polyethylene, latex and rubber; circular drag member 12 attaching to the tubular weighted member bottom 14C causing drag on the bottom of the body of water's floor; circular drag member left quadrant 12A being a segment of the drag member 12 aiding in semi-attaching the releasable anchor 10 to the bottom of the body of water's floor; circular drag member left-rear wedge 12AB being a segment of the drag member 12 between the circular drag member left quadrant 12A and the circular drag member rear quadrant 12B allowing small extrusions from the bottom of the body of water's floor to get caught, thus anchoring the boat to the bottom; circular drag member rear quadrant 12B being a segment of the drag member 12 aiding in semi-attaching the releasable anchor 10 to the bottom of the body of water's floor; circular drag member rear-right wedge 12BC being a segment of the drag member 12 between the circular drag member rear quadrant 12B and the circular drag member right quadrant 12C allowing small extrusions from the bottom of the body of water's floor to get caught, thus anchoring the boat to the bottom; circular drag member right quadrant 12C being a segment of the drag member 12 aiding in semi-attaching the releasable anchor 10 to the bottom of the body of water's floor; circular drag member right-front wedge 12CD being a segment of the drag member 12 between the circular drag member right quadrant 12C and the circular drag member front quadrant 12D allowing small extrusions from the bottom of the body of water's floor to get caught, thus, anchoring the boat to the bottom; circular drag member front quadrant 12D being a segment of the drag member 12 aiding in semi-attaching the releasable anchor 10 to the bottom of the body of water's floor; circular drag member front-left wedge 12DA being a segment of the drag member 12 between the circular drag member left quadrant 12A and the circular drag member front quadrant 12D allowing small extrusions from the bottom of the body of water's floor to get caught, thus anchoring the boat to the bottom; tubular weighted member 14 having a tubular weighted member top 14A and a tubular weighted member elastic insertion aperture 14AA in which an elastic strip 16 being inserted into the tubular weighted member central bore 14D causing tension within the tubular weighted member central bore 14D; tubular weighted member top 14A having a tubular weighted member elastic insertion aperture 14AA in which the elastic strip 16 being inserted to form the releasable anchor 10; tubular weighted member elastic insertion aperture 14AA allowing the elastic strip 16 to be inserted into the tubular weighted member central bore 14D; tubular weighted member outer wall 14B enclosing the elastic strip 16 causing tension up to the release requirement of the releasable anchor 10; tubular weighted member bottom 14C attaches to the tubular weighted member outer wall 14B forming the complete releasable anchor 10; tubular weighted member central bore 14D having the elastic strip 16 inserted within causing tension on the tubular weighted member central bore 14D; elastic strip 16 inserting into the tubular weighted member central bore 14D causing tension within the tubular weighted member central bore 14D requiring an additional amount of release pulling in order to pull the elastic strip 16 through the tubular weighted member central bore 14D and thus releasing the tubular weighted member 14 from the anchor line; elastic strip closed eye 16A being formed when the elastic strip 16 is inserted into the tubular weighted member central bore 14D; elastic strip central bore 16B forcing tension on the tubular weighted member central bore 14D; elastic strip lower central bore 16C being pulled through the tubular weighted member central bore 14D until all the elastic strip is within the tubular weighted member central bore 14D; and elastic strip anchor line attachment loop 16D being formed when the elastic strip 16 is inserted into the tubular weighted member central bore 14D.

Figure 1A:
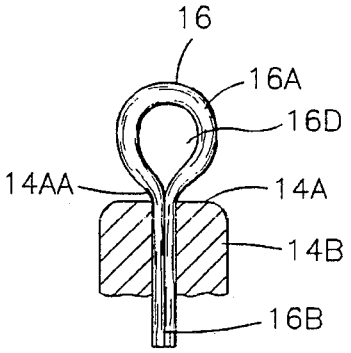
FIG. 1A is a cross-sectional view of the elastic material wedged into the tubular member.

Now, referring to FIG. 1A being a cross-sectional view of the elastic material wedged into the tubular member, exhibiting the following features: tubular weighted member top 14A having a tubular weighted member elastic insertion aperture 14AA in which the elastic strip 16 being inserted to form the releasable anchor 10; tubular weighted member elastic insertion aperture 14AA allowing the elastic strip 16 to be inserted into the tubular weighted member central bore 14D; tubular weighted member outer wall 14B enclosing the elastic strip 16 causing tension up to the release requirement of the releasable anchor 10; elastic strip 16 inserting into the tubular weighted member central bore 14D causing tension within the tubular weighted member central bore 14D requiring an additional amount of release pulling in order to pull the elastic strip 16 through the tubular weighted member central bore 14D and thus releasing the tubular weighted member 14 from the anchor line; elastic strip closed eye 16A being formed when the elastic strip 16 is inserted into the tubular weighted member central bore 14D; elastic strip central bore 16B forcing tension on the tubular weighted member central bore 14D; elastic strip anchor line attachment loop 16D being formed when the elastic strip 16 is inserted into the tubular weighted member central bore 14D.

Figure 2:
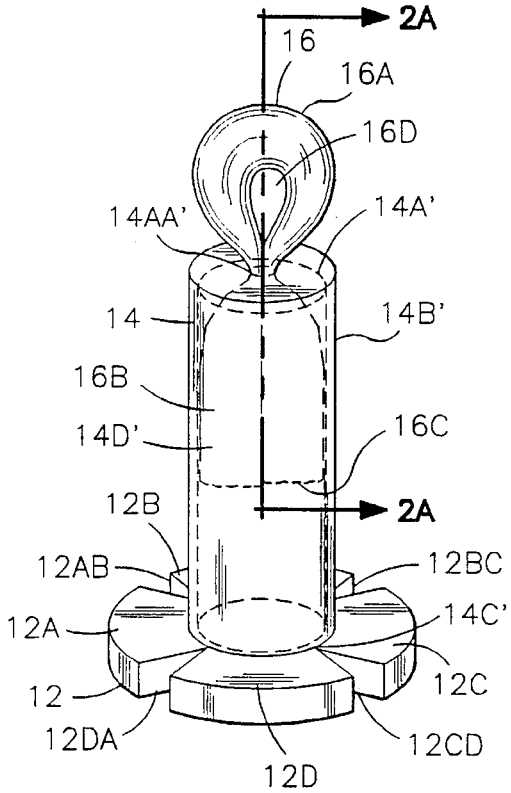
FIG. 2 is a pictorial view of the releasable anchor with the elastic material constrained against the tubular member aperture.

Now, referring to FIG. 2 being a pictorial view of the fishing sinker open sleeve member having interchangeable weights exhibiting the following features: releasable anchor 10 comprising a drag member 12, a tubular weighted member 14, and an elastic strip 16; spherical drag member 12 attaching to the tubular weighted member bottom 14C causing drag on the bottom of the body of water's floor; spherical drag member left quadrant 12A being a segment of the drag member 12 aiding in semi-attaching the releasable anchor 10 to the bottom of the body of water's floor; spherical drag member left-rear wedge 12AB being a segment of the drag member 12 between the spherical drag member left quadrant 12A and the spherical drag member rear quadrant 12B allowing small extrusions from the bottom of the body of water's floor to get caught, thus anchoring the boat to the bottom; spherical drag member rear quadrant 12B being a segment of the drag member 12 aiding in semi-attaching the releasable anchor 10 to the bottom of the body of water's floor; spherical drag member rear-right wedge 12BC being a segment of the drag member 12 between the spherical drag member rear quadrant 12B and the spherical drag member right quadrant 12C allowing small extrusions from the bottom of the body of water's floor to get caught, thus anchoring the boat to the bottom; spherical drag member right quadrant 12C being a segment of the drag member 12 aiding in semi-attaching the releasable anchor 10 to the bottom of the body of water's floor; spherical drag member right-front wedge 12CD being a segment of the drag member 12 between the spherical drag member right quadrant 12C and the spherical drag member front quadrant 12D allowing small extrusions from the bottom of the body of water's floor to get caught, thus, anchoring the boat to the bottom; spherical drag member front quadrant 12D being a segment of the drag member 12 aiding in semi-attaching the releasable anchor 10 to the bottom of the body of water's floor; spherical drag member front-left wedge 12DA being a segment of the drag member 12 between the spherical drag member left quadrant 12A and the spherical drag member front quadrant 12D allowing small extrusions from the bottom of the body of water's floor to get caught, thus anchoring the boat to the bottom; open tubular weighted member 14' having a tubular weighted member top 14A' and a tubular weighted member elastic insertion aperture 14AA' in which an elastic strip 16 being inserted into the tubular weighted member central bore 14D' causing tension within the tubular weighted member central bore 14D'; open tubular weighted member top 14A' having a tubular weighted member elastic insertion aperture 14AA' in which the elastic strip 16 being inserted to form the releasable anchor 10; tubular weighted member elastic insertion aperture 14AA allowing the elastic strip 16 to be inserted into the tubular weighted member central bore 14D; open tubular weighted member elastic insertion aperture 14AA' allowing the elastic strip 16 to be inserted into the tubular weighted member central bore 14D'; tubular weighted member outer wall 14B enclosing the elastic strip 16 causing tension up to the release requirement of the releasable anchor 10; open tubular weighted member outer wall 14B' enclosing the elastic strip 16 causing tension up to the release requirement of the releasable anchor 10; open tubular weighted member bottom 14C' attaches to the tubular weighted member outer wall 14B' forming the complete releasable anchor 10; open tubular weighted member central bore 14D' having the elastic strip 16 inserted within causing tension on the open tubular weighted member top 14A'; elastic strip 16 inserting into the tubular weighted member central bore 14D causing tension within the tubular weighted member central bore 14D requiring an additional amount of release pulling in order to pull the elastic strip 16 through the tubular weighted member central bore 14D and thus releasing the tubular weighted member 14 from the anchor line; elastic strip closed eye 16A being formed when the elastic strip 16 is inserted into the tubular weighted member central bore 14D; elastic strip central bore 16B forcing tension on the tubular weighted member central bore 14D; elastic strip lower central bore 16C being pulled through the tubular weighted member central bore 14D until all the elastic strip is within the tubular weighted member central bore 14D; and elastic strip anchor line attachment loop 16D being formed when the elastic strip 16 is inserted into the tubular weighted member central bore 14D.

Figure 2A:
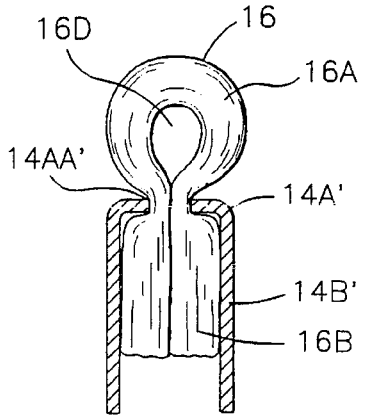
FIG. 2A is a cross-sectional view of the elastic material constrained against the tubular member aperture.

Now, referring to FIG. 2A being a cross-sectional view of the elastic material constrained against the tubular member aperture, exhibiting the following features: open tubular weighted member top 14A' having a tubular weighted member elastic insertion aperture 14AA' in which the elastic strip 16 being inserted to form the releasable anchor 10; open tubular weighted member elastic insertion aperture 14AA' allowing the elastic strip 16 to be inserted into the tubular weighted member central bore 14D'; open tubular weighted member outer wall 14B' enclosing the elastic strip 16 causing tension up to the release requirement of the releasable anchor 10; elastic strip 16 inserting into the tubular weighted member central bore 14D causing tension within the tubular weighted member central bore 14D requiring an additional amount of release pulling in order to pull the elastic strip 16 through the tubular weighted member central bore 14D and thus releasing the tubular weighted member 14 from the anchor line; elastic strip closed eye 16A being formed when the elastic strip 16 is inserted into the tubular weighted member central bore 14D; elastic strip central bore 16B forcing tension on the tubular weighted member central bore 14D; and elastic strip anchor line attachment loop 16D being formed when the elastic strip 16 is inserted into the tubular weighted member central bore 14D.

Figure 3:
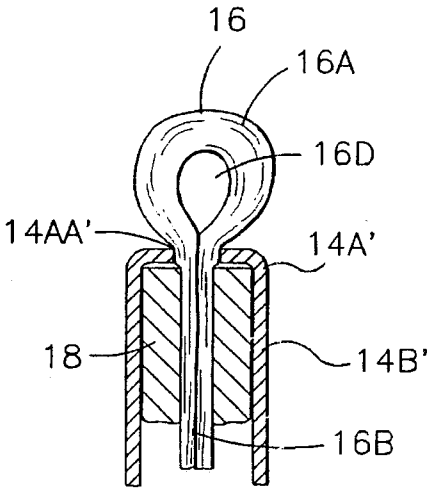
FIG. 3 is a cross-sectional view of the releasable anchor with the elastic material constrained against an insert within the tubular member.

Now, referring to FIG. 3 being a cross-sectional view of the releasable anchor with the elastic material constrained against an insert within the tubular member, exhibiting the following features: open tubular weighted member top 14A' having a tubular weighted member elastic insertion aperture 14AA' in which the elastic strip 16 being inserted to form the releasable anchor 10; open tubular weighted member elastic insertion aperture 14AA' allowing the elastic strip 16 to be inserted into the tubular weighted member central bore 14D'; open tubular weighted member outer wall 14B' enclosing the elastic strip 16 causing tension up to the release requirement of the releasable anchor 10; elastic strip 16 inserting into the tubular weighted member central bore 14D causing tension within the tubular weighted member central bore 14D requiring an additional amount of release pulling in order to pull the elastic strip 16 through the tubular weighted member central bore 14D and thus releasing the tubular weighted member 14 from the anchor line; elastic strip closed eye 16A being formed when the elastic strip 16 is inserted into the tubular weighted member central bore 14D; elastic strip central bore 16B forcing tension on the tubular weighted member central bore 14D; and elastic strip anchor line attachment loop 16D being formed when the elastic strip 16 is inserted into the tubular weighted member central bore 14D; adaptable tension sleeve 18 being inserted in the open tubular weighted member central bore 14D' varying the amount of tension needed to pull the elastic strip 16 through the open tubular weighted member central bore 14D' to release the releasable anchor 10.

Figure 4:
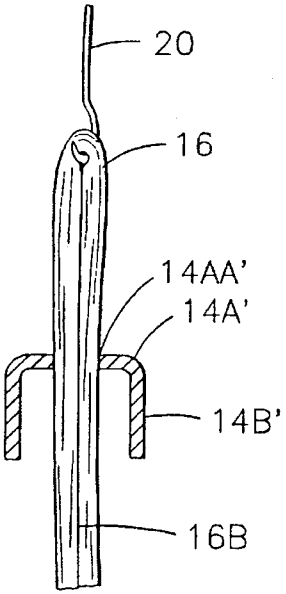
FIG. 4 is a cross-sectional view showing the method of inserting the elastic material into the tubular member aperture.

Now, referring to FIG. 4 being a cross-sectional view of the elastic material being inserted into the tubular member aperture, exhibiting the following features: open tubular weighted member top 14A' having a tubular weighted member elastic insertion aperture 14AA' in which the elastic strip 16 being inserted to form the releasable anchor 10; open tubular weighted member elastic insertion aperture 14AA' allowing the elastic strip 16 to be inserted into the tubular weighted member central bore 14D'; open tubular weighted member outer wall 14B' enclosing the elastic strip 16 causing tension up to the release requirement of the releasable anchor 10; elastic strip 16 inserting into the tubular weighted member central bore 14D causing tension within the tubular weighted member central bore 14D requiring an additional amount of release pulling in order to pull the elastic strip 16 through the tubular weighted member central bore 14D and thus releasing the tubular weighted member 14 from the anchor line; elastic strip closed eye 16A being formed when the elastic strip 16 is inserted into the tubular weighted member central bore 14D; elastic strip central bore 16B forcing tension on the tubular weighted member central bore 14D; and elastic strip anchor line attachment loop 16D being formed when the elastic strip 16 is inserted into the tubular weighted member central bore 14D; elastic strip hook-end insertion tool 20 pulls the elastic strip 16 through the elastic strip central bore 16B forming the elastic strip anchor line attachment loop 16D.

Figure 5:
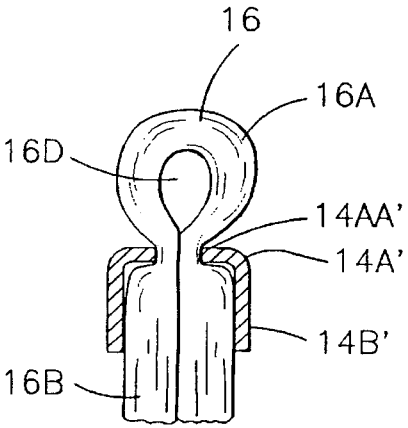
FIG. 5 is a cross-sectional view of the elastic material just after release into the tubular member aperture.

Lastly, referring to FIG. 5 being a cross-sectional view of the elastic material just after release into the tubular member aperture, exhibiting the following features: open tubular weighted member top 14A' having a tubular weighted member elastic insertion aperture 14AA' in which the elastic strip 16 being inserted to form the releasable anchor 10; open tubular weighted member elastic insertion aperture 14AA' allowing the elastic strip 16 to be inserted into the tubular weighted member central bore 14D'; open tubular weighted member outer wall 14B' enclosing the elastic strip 16 causing tension up to the release requirement of the releasable anchor 10; elastic strip 16 inserting into the tubular weighted member central bore 14D' causing tension within the tubular weighted member central bore 14D' requiring an additional amount of release pulling in order to pull the elastic strip 16 through the tubular weighted member central bore 14D and thus releasing the tubular weighted member 14 from the anchor line; elastic strip closed eye 16A being formed when the elastic strip 16 is inserted into the tubular weighted member central bore 14D; elastic strip central bore 16B forcing tension on the tubular weighted member central bore 14D; and elastic strip anchor line attachment loop 16D being formed when the elastic strip 16 is inserted into the tubular weighted member central bore 14D.

It will be understood that each of the elements described above, or two or more together, may also find a useful application in other types of constructions differing from the type described above.

While the invention has been illustrated and described as embodied in a releasable anchor, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A releasable anchor comprising:

a) a weighted body having:
- i) a distal top end,
- ii) a distal bottom end, and
- iii) a central bore extending lengthwise throughout said weighted body from said distal top end to said distal bottom end;

b) an elastic strip receivable to said central bore of said weighted body forming an enclosed eye on said distal top end of said weighted body for attaching an anchor line and frictionally and compressively held within said central bore of said weighted body, and removable upon sufficient longitudinal tension being applied to said elastic strip causing said elastic strip to pull out of said weighted body; and c) a drag member attached to said distal bottom end of said weighted body.

2. The releasable anchor as described in claim 1, whereas said weighted body being tubular in shape.

3. The releasable anchor as described in claim 1, whereas said drag member being generally circular in shape.

4. The releasable anchor as described in claim 3, whereas said drag member having wedges cut into said drag member functioning to catch and hold against subsurface objects.

5. The releasable anchor as described in claim 1, whereas the material of construction of said weighted body is taken from the group of materials including metal, metal alloys, lead, steel, cast iron, and aluminum.

6. The releasable anchor as described in claim 1, whereas the material of construction of said elastic strip is taken from the group of materials including nylon, polypropylene, polyethylene, latex and rubber.

7. A releasable anchor comprising:

a) a weighted body having:
- i) a distal top end;
- ii) a distal bottom end;
- iii) an aperture on said distal top end; and
- iv) a open hollow area extending lengthwise throughout said weighted body from said aperture on said distal top end to said distal bottom end;

b) an elastic strip receivable to said open hollow area of said weighted body forming an enclosed eye on said distal top end of said weighted body for attaching an anchor line, frictionally and compressively held against said aperture of said weighted body, and removable upon sufficient longitudinal tension being applied to said elastic strip causing said elastic strip to pull out of said weighted body; and c) a drag member attached to said distal bottom end of said weighted body.

8. The releasable anchor as described in claim 7, whereas the material of construction of said weighted body is taken from the group of materials including metal, metal alloys, lead, steel, cast iron, and aluminum.

9. The releasable anchor as described in claim 7, whereas the material of construction of said elastic strip is taken from the group of materials including nylon, polypropylene, polyethylene, latex and rubber.

10. The releasable anchor as described in claim 7, whereas said weighted body being tubular in shape.

11. The releasable anchor as described in claim 7, whereas said drag member being circular in shape.

12. The releasable anchor as described in claim 11, whereas said drag member having wedges cut into said drag member functioning to catch and hold a body of water's bottom.

13. The releasable anchor as described in claim 7 further including a cylindrical insert within the tubular member, said insert providing a central bore for accepting the elastic strip, and an outside diameter greater than the elastic insertion aperture, such that the insert provides frictional holding force of the elastic strip.

* * * * *